US011262086B2

(12) United States Patent
Cai et al.

(10) Patent No.: US 11,262,086 B2
(45) Date of Patent: Mar. 1, 2022

(54) INDOOR UNIT, AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Zhicai Cai, Guangdong (CN); Kuifang Zou, Guangdong (CN); Wenjun Luo, Guangdong (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 270 days.

(21) Appl. No.: 16/583,383

(22) Filed: Sep. 26, 2019

(65) Prior Publication Data

US 2020/0370763 A1 Nov. 26, 2020

Related U.S. Application Data

(63) Continuation of application No. PCT/CN2019/103801, filed on Aug. 30, 2019.

(30) Foreign Application Priority Data

May 22, 2019 (CN) ..... 201920749002.9

(51) Int. Cl.
*F24F 1/0057* (2019.01)

(52) U.S. Cl.
CPC ..... *F24F 1/0057* (2019.02)

(58) Field of Classification Search
CPC .. F24F 1/0057; F24F 2013/205; F24F 1/0043; F24F 1/0011
USPC ..... 62/263
See application file for complete search history.

(56) References Cited

U.S. PATENT DOCUMENTS

| | | | | |
|---|---|---|---|---|
| 4,912,940 | A | 4/1990 | Anderson et al. | |
| 2014/0373565 | A1 | 12/2014 | Melbostad et al. | |
| 2020/0208870 | A1 * | 7/2020 | Wang | F24F 1/0057 |

FOREIGN PATENT DOCUMENTS

| | | | | |
|---|---|---|---|---|
| CN | 101672457 | A | 3/2010 | |
| CN | 102261700 | A | 11/2011 | |
| CN | 104501306 | A | 4/2015 | |
| CN | 107588519 | A * | 1/2018 | F24F 1/0057 |

(Continued)

OTHER PUBLICATIONS

Opinion dated Nov. 19, 2020 received in Korean Patent Application No. KR 10-2019-7030995 together with an English language translation.

(Continued)

*Primary Examiner* — Steve S Tanenbaum
(74) *Attorney, Agent, or Firm* — Scully Scott Murphy & Presser

(57) ABSTRACT

Disclosed are an indoor unit and an air conditioner having the indoor unit. The indoor unit has a housing having a chassis that can be mounted to a wall, and a front frame connected with the chassis, in which the front frame and the chassis can be joined to define a mounting cavity having a mounting mouth opened downwards, and a fan assembly positioned in the mounting cavity and exposed to an outside at the mounting mouth, in which the fan assembly can be removably connected with the front frame and the chassis.

14 Claims, 9 Drawing Sheets

(56) References Cited

FOREIGN PATENT DOCUMENTS

| | | | |
|---|---|---|---|
| CN | 206905125 | U | 1/2018 |
| CN | 207407442 | U | 5/2018 |
| EP | 3 279 584 | A1 | 2/2018 |
| KR | 10-2006-0072810 | A | 6/2006 |
| WO | 2006/080793 | A2 | 8/2006 |
| WO | 2019/056690 | A1 | 3/2019 |

OTHER PUBLICATIONS

Extended European Search Report dated Nov. 24, 2020 received in European Patent Application No. EP 19772640.9.
Search Report and Written Opinion dated Feb. 19, 2020 received in International Patent Application No. PCT/CN2019/103801 together with an English language translation.

* cited by examiner

INDOOR UNIT, AND AIR CONDITIONER

CROSS REFERENCE TO RELATED APPLICATIONS

The subject application is a Continuation Application of PCT International Patent Application No. PCT/CN2019/103801 filed on Aug. 30, 2019, which claims priority to Chinese Patent Application No. 201920749002.9, entitled "Indoor Unit, and Air Conditioner," filed on May 22, 2019, the entire content of PCT International Patent Application No. PCT/CN2019/103801 and Chinese Patent Application No. 201920749002.9 are hereby incorporated by reference.

TECHNICAL FIELD

The present disclosure relates to the technical field of air conditioning equipment, in particular to an indoor unit, and an air conditioner including the indoor unit.

BACKGROUND

The fan assembly of conventional wall-mounted air conditioners is typically fixed on the chassis of the housing and provided non-removably. Dust can accumulate on the fan assembly when the air conditioner and such structure therein have been long-term used. And it is almost impossible to have room for fan assembly cleaning without removing the front frame of the air conditioner. In addition, such a structure can make replacement and repair of the motor of the fan assembly inconvenient.

The aforementioned is of assistance in understanding the technical solution of the present disclosure, and does not necessarily admit that the aforementioned constitutes the prior art.

SUMMARY

The present disclosure is to provide an indoor unit of an air conditioner, aiming to provide improvement in the disassembling convenience and assembling fitness with respect to the indoor unit of the air conditioner.

In order to achieve the aforementioned objective, the indoor unit proposed in the present disclosure includes:

a housing including a chassis and a front frame connected with the chassis, in which the front frame and the chassis are jointly enclosed to form a mounting cavity having a mounting mouth open downwards; and a fan assembly positioned in the mounting cavity and exposed at the mounting mouth, in which the fan assembly is removably connected with the front frame; the fan assembly is removably connected with the chassis.

In one embodiment, one of the front frame and the fan assembly is provided with a first buckle, the other one is provided with a first buckle slot; the front frame is removably connected with the fan assembly through a snap fit between the first buckle and the first buckle slot.

In one embodiment, one of the chassis and the fan assembly is provided with a second buckle and the other one is provided with a second buckle slot; the chassis is removably connected with the fan assembly through a snap fit between the second buckle and the second buckle slot.

In one embodiment, a portion of the front frame adjacent to the mounting mouth is provided with a first buckle, and a portion of the chassis adjacent to the mounting mouth is provided with a second buckle; a portion of the fan assembly adjacent to the front frame is provided with a first buckle slot fit with the first buckle, and another portion of the fan assembly adjacent to the chassis is provided with a second buckle slot fit with the second buckle.

In one embodiment, the first buckle and the second buckle each includes a main body portion, a rotating portion connected to the main body portion, and a buckling portion;

the first buckle is rotatably connected with the front frame through the rotating portion, and the first buckle is in a snap fit with the first buckle slot through the buckling portion.

the second buckle is rotatably connected with the chassis through the rotating portion, and the second buckle is in a snap fit with the second buckle slot through the buckling portion.

In one embodiment, the rotating portion is provided with a rotating shaft, a portion of the front frame adjacent to the mounting mouth is provided with a first shaft aperture fit with the rotating shaft, and the first buckle is rotatably connected with the front frame through a fit between the rotating shaft and the first shaft aperture;

a portion of the chassis adjacent to the mounting mouth is provided with a second shaft aperture fit with the rotating shaft, and the second buckle is rotatably connected with the chassis through a fit between the rotating shaft and the second shaft aperture.

In one embodiment, an outer periphery of the first shaft aperture and/or the second shaft aperture is provided with a guiding surface configured to slide the rotating shaft in.

In one embodiment, an end surface of the rotating shaft is provided with a mating surface configured to slide the rotating shaft into the first shaft aperture or the second shaft aperture.

In one embodiment, the front frame is further provided with a first avoiding area communicating the first shaft aperture and the mounting mouth; and a part of the main body portion is accommodated in the first avoiding area, when the front frame is connected with the fan assembly through the first buckle.

In one embodiment, the chassis is further provided with a second avoiding area communicating the second shaft aperture and the mounting mouth; and a part of the main body portion is accommodated in the second avoiding area, when the chassis is connected with the fan assembly through the second buckle.

In one embodiment, the fan assembly includes a volute having a first boss adjacent to the front frame and a fan connected with the volute, in which the first boss is provided with the first buckle slot penetrating through the first boss in an up-down direction; the volute is further provided with a second boss adjacent to the chassis, in which the second boss is provided with the second buckle slot penetrating through the second boss in an up-down direction;

the buckling portion is a buckling hook, in which the first buckle is rotated relative to the front frame, to allow the buckling hook to be in a snap fit at a lower end of the first buckle slot; and the second buckle is rotated relative to the chassis, to allow the buckling hook to be in a snap fit at an lower end of the second buckle slot.

In one embodiment, the volute has an opening corresponding to the fan.

In one embodiment, the front frame is provided with a plurality of the first buckles spaced part; the chassis is provided with a plurality of the second buckles spaced apart; the volute respectively is provided with a plurality of the first buckle slots spaced apart and a plurality of the second buckle slots spaced apart.

The present disclosure further provides an indoor unit, which includes:

a housing including a chassis and a front frame connected with the chassis, in which the front frame and the chassis are jointly enclosed to form a mounting cavity having a mounting mouth open downwards; the front frame is provided with an air inlet communicated with mounting cavity away from the mounting mouth;

a fan assembly positioned in the mounting cavity and exposed at the mounting mouth, in which the fan assembly is removably connected with the front frame; the fan assembly is further removably connected with the chassis; and a heat exchanger provided in the mounting cavity and positioned between the air inlet and the fan assembly.

The present disclosure further provides an air conditioner, which includes an outdoor unit and an indoor unit, in which the outdoor unit is connected with the indoor unit through a pipeline, and the indoor unit includes:

a housing including a chassis and a front frame connected with the chassis, in which the front frame and the chassis are jointly enclosed to form a mounting cavity having a mounting mouth open downwards; and a fan assembly positioned in the mounting cavity, in which the fan assembly is removably connected with the front frame; the fan assembly is further removably connected with the chassis; the fan assembly is exposed at the mounting mouth.

In one embodiment, a portion of the front frame adjacent to the mounting mouth is provided with a first buckle, and a portion of the chassis adjacent to the mounting mouth is provided with a second buckle; a first portion of the fan assembly adjacent to the front frame is provided with a first buckle slot fit with the first buckle, and a second portion of the fan assembly adjacent to the chassis is provided with a second buckle slot fit with the second buckle.

In one embodiment, the first buckle and the second buckle each includes a main body portion, a rotating portion connected to the main body portion, and a buckling portion;

the first buckle is rotatably connected with the front frame through the rotating portion, and the first buckle is in a snap fit with the first buckle slot through the buckling portion;

the second buckle is rotatably connected with the chassis through the rotating portion, and the second buckle is in a snap fit with the second buckle slot through the buckling portion.

In one embodiment, the rotating portion is provided with a rotating shaft, a portion of the front frame adjacent to the mounting mouth is provided with a first shaft aperture fit with the rotating shaft, and the first buckle is rotatably connected with the front frame through a fit between the rotating shaft and the first shaft aperture;

a portion of the chassis adjacent to the mounting mouth is provided with a second shaft aperture fit with the rotating shaft, and the second buckle is rotatably connected with the chassis through a fit between the rotating shaft and the second shaft aperture.

In one embodiment, the front frame further is provided with a first avoiding area communicating between the first shaft aperture and the mounting mouth; and a part of the main body portion is accommodated in the first avoiding area, when the front frame is connected with the fan assembly through the first buckle;

and/or, the chassis is provided with a second avoiding area communicating between the second shaft aperture and the mounting mouth; and a part of the main body portion is accommodated in the second avoiding area, when the chassis is connected with the fan assembly through the second buckle.

In one embodiment, the fan assembly includes a volute having a first boss adjacent to the front frame and a fan connected with the volute, in which the first boss is provided with the first buckle slot penetrating through the first boss in an up-down direction; the volute is further provided with a second boss adjacent to the chassis, in which the second boss is provided with the second buckle slot penetrating through the second boss in an up-down direction;

the buckling portion is a buckling hook, in which the first buckle is rotated relative to the front frame, to allow the buckling hook to be in a snap fit at a lower end of the first buckle slot; and the second buckle is rotated relative to the chassis, to allow the buckling hook to be in a snap fit at an lower end of the second buckle slot.

According to the technical solution of the present disclosure, the front frame and the chassis are enclosed to form a mounting cavity, and the mounting cavity is provided with a mounting mouth open downwards, the fan assembly is removably connected with the front frame and the chassis respectively, and the fan assembly is exposed at the mounting mouth. As such, a larger space is available to assemble, disassemble, and clean the fan assembly, improving convenience in cleaning the fan assembly of the indoor unit. In addition, the fan assembly is removably connected to the front frame and the chassis, so that it would be more stable for the fan assembly to be mounted on the housing. The exposure to danger by opening the fan assembly accidentally will be further lowered, with the structural stability enhanced of the indoor unit and working performance improved.

BRIEF DESCRIPTION OF THE DRAWINGS

In order to explain the embodiment of the present disclosure or the technical solution of the prior art more clearly, the following will briefly introduce the drawings necessary in the description of the embodiments or the prior art. Obviously, the drawings in the following description are only some embodiments of the present disclosure. For those of ordinary skill in the art, other drawings can be obtained according to the structure shown in these drawings without any creative effort.

DESCRIPTION OF REFERENCE NUMERAL

Figure 1:
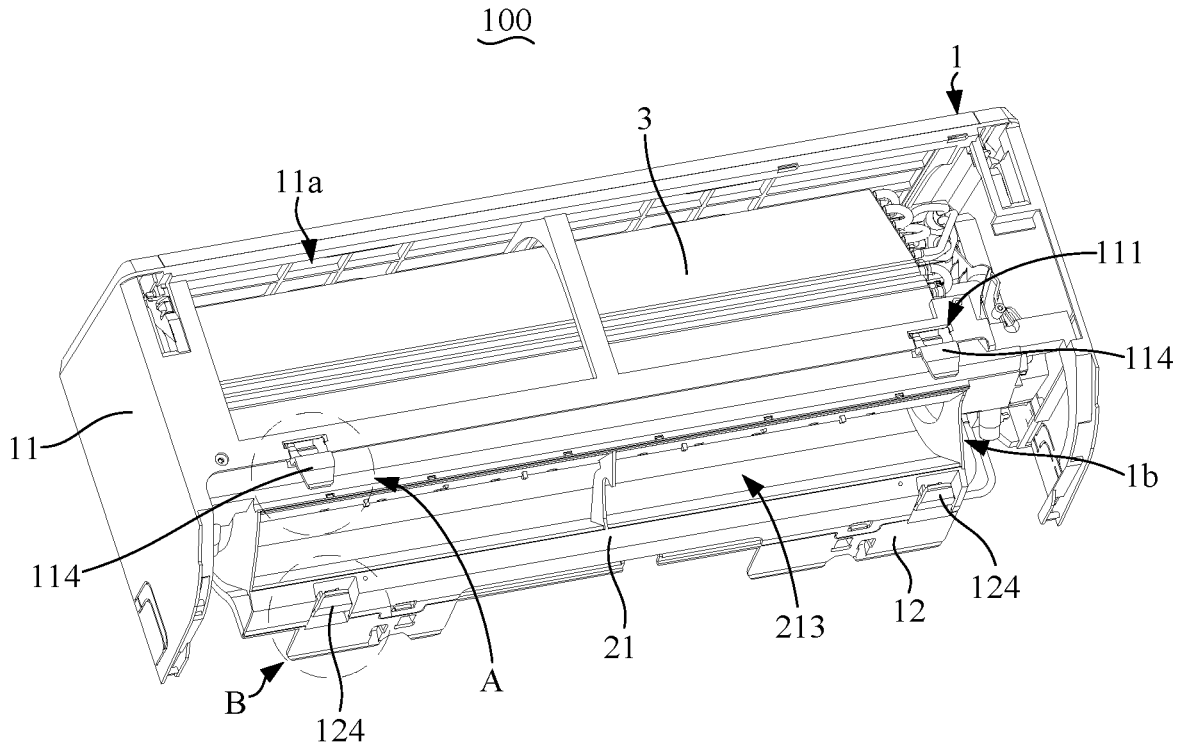
FIG. 1 is a schematic structural diagram of an indoor unit according to an embodiment of the present disclosure.

| Reference Numeral | Name |
|---|---|
| 100 | Indoor unit |
| 1 | Housing |
| 1a | Mounting cavity |
| 1b | Mounting mouth |
| 11 | Front frame |
| 11a | Air inlet |
| 111 | First shaft aperture |
| 112 | Guiding surface |
| 113 | First avoiding area |
| 114 | First buckle |
| 1141 | Main body portion |
| 1142 | Rotating portion |
| 1143 | Buckling portion |
| 115 | Rotating shaft |
| 116 | Mating surface |
| 117 | Buckling hook |
| 12 | Chassis |
| 121 | Second shaft aperture |
| 123 | Second avoiding area |
| 124 | Second buckle |
| 2 | Fan assembly |
| 21 | Volute |
| 211 | First buckle slot |
| 212 | Second buckle slot |
| 213 | Opening |
| 214 | First boss |
| 215 | Second boss |
| 22 | Fan |
| 3 | Heat exchanger |

The implementation, functional characteristics and advantages of the present disclosure will be further described with reference to the attached drawings in combination with embodiments.

DETAILED DESCRIPTION OF THE EMBODIMENTS

As following, the technical solution in the embodiments of the present disclosure will be described clearly and completely with reference to the drawings in the embodiment of the present disclosure. Obviously, the described embodiment is only a part of the embodiment of the present disclosure, not all of the embodiments. Based on the embodiments in the present disclosure, all other embodiments perceived by those ordinary skills in the art without creative effort should be fallen within the protection scope of the present disclosure.

It should be noted that all directional indicators (such as upper, lower, left, right, front, rear, etc.) in the embodiment of the present disclosure are only intended to explain the relative positional relationship, movement, etc. between various components under a certain specific posture (as shown in the drawings). If the specific posture changes, the directional indicator will also change accordingly.

Additionally, the meaning of "and/or" appearing in the full text is to include three solutions, taking "A and/or B" as an example, including solution A, or solution B, or the solution where A and B are both met.

In addition, the descriptions related to "first", "second" and the like in the present disclosure are for descriptive purposes only and cannot be noted as indicating or implying its relative importance or implicitly indicating a number of technical features indicated. Thus, features defining "first" and "second" may explicitly or implicitly include at least one of the features. In addition, the technical solutions between the various embodiments may be combined with each other, but must be based on what one of ordinary skill in the art can achieve. When the combination of technical solutions is contradictory or impossible to achieve, it should be considered that the combination of such technical solutions does not exist and is not within the protection scope required by the present disclosure.

The present disclosure provides an indoor unit 100 of an air conditioner.

Figure 4:
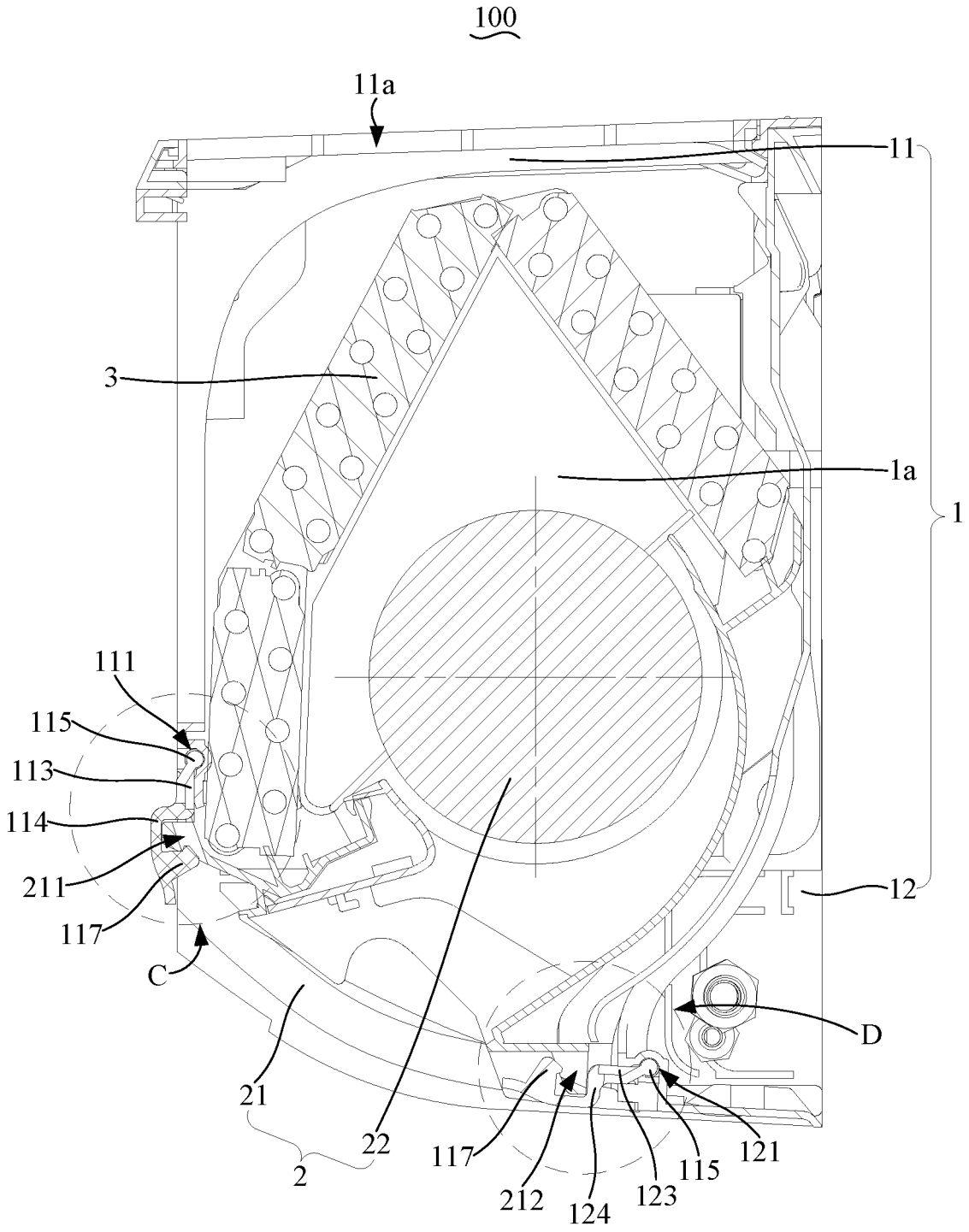
FIG. 4 is a schematic cross-sectional view of an indoor unit according to an embodiment of the present disclosure.
Figure 5:
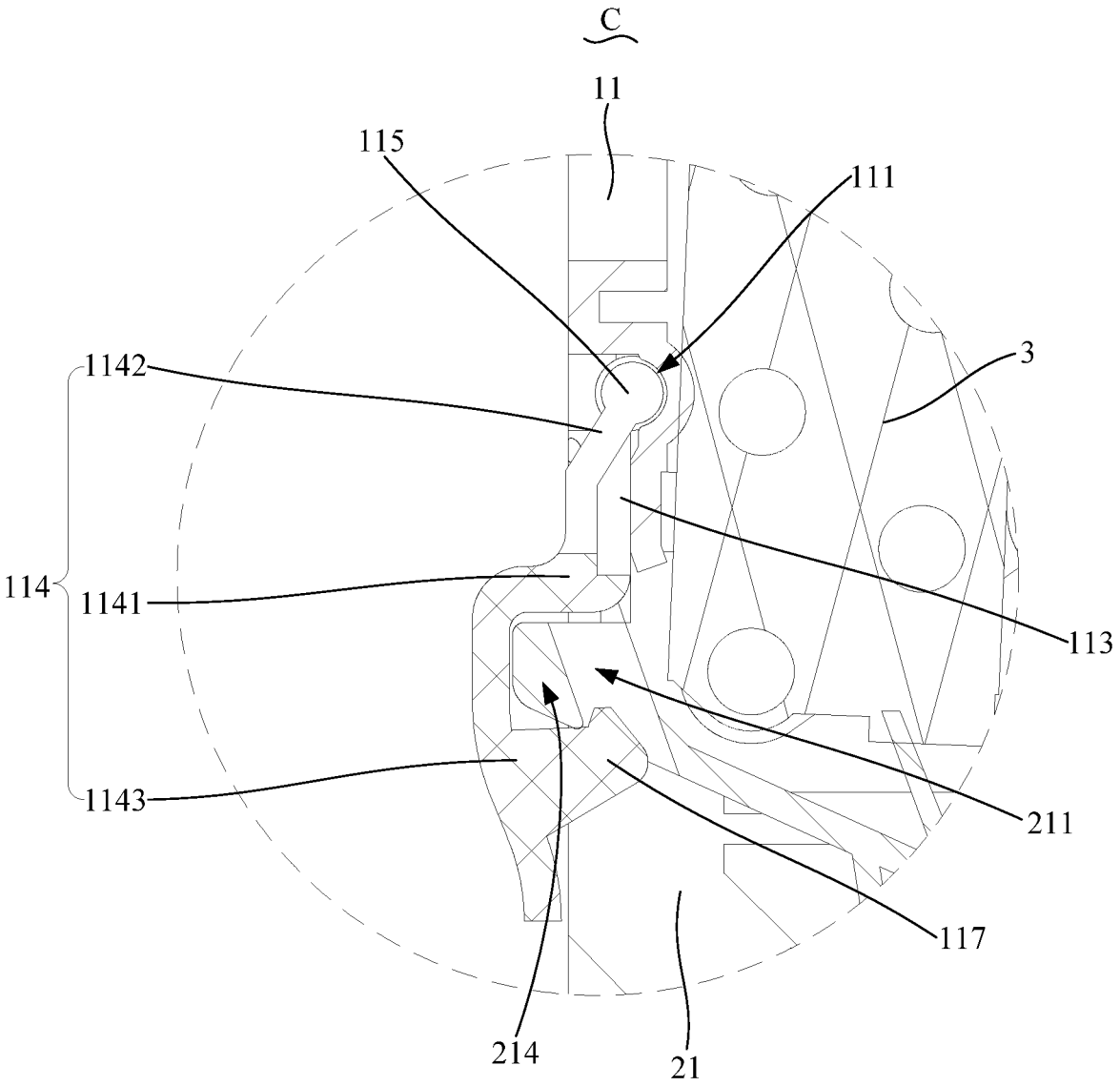
FIG. 5 is an enlarged schematic diagram at position C in FIG. 4.

Referring to FIGS. 1 and 4, in the embodiments of the present disclosure, the indoor unit 100 includes a housing 1 and a fan assembly 2, in which the housing 1 includes a chassis 12 and a front frame 11 connected with the chassis 12. The front frame 11 and the chassis 12 are enclosed to form a mounting cavity 1*a*, and the mounting cavity 1*a* has a mounting mouth 1*b* open downwards. The fan assembly 2 is positioned in the mounting cavity 1*a*, which is removably connected with the front frame 11, and also removably connected with the chassis 12. The fan assembly 2 is exposed at the mounting mouth 1*b*.

In the present embodiment, the housing 1 has a mounting cavity 1*a*. That is, the front frame 11 and the chassis 12 are connected to form a mounting cavity 1*a*, and the mounting cavity 1*a* has a mounting mouth 1*b* open downward, which means, the front frame 11 and the chassis 12 are also enclosed to form a mounting mouth 1*b* communicated with the mounting cavity 1*a*. The fan assembly 2 includes a volute 21 and a fan 22 connected with the volute 21. In which, the fan assembly 2 is removably mounted on the mounting mouth 1*b* through the volute 21. The fan 22 is mounted on the volute 21 and positioned in the mounting cavity 1*a*. A wall-mounted plate (not shown) is removably connected to the surface of the chassis 12 facing away from the front frame 11, and the indoor unit 100 is mounted on the wall through the wall-mounted plate.

In one embodiment, the volute 21 has an opening 213, and the front frame 11 is provided with an air inlet 11*a* communicated with the mounting cavity 1*a* away from the mounting mouth 1*b*. That is, the top wall of the front frame 11 is provided with an air inlet 11*a*, and air flows into the indoor unit 100 from the top. The indoor unit 100 further includes a heat exchanger 3, some electric control components and the like. The heat exchanger 3 and the electric control components are accommodated in the mounting cavity 1*a*. The heat exchanger 3 is positioned between the air inlet 11*a* and the fan assembly. The electric control components are installed on the front frame 11 or the chassis 12 at one end of the heat exchanger 3. Such arrangement facilitates the wire connection of the indoor unit 100. In the present embodiment, the air outdoor enters into the mounting cavity 1*a* through the air inlet 11*a*, with the heat exchanged with the heat exchanger 3. Then the airflow in the mounting cavity 1*a* is guided out of the mounting cavity 1*a* through the opening 213 of the volute 21 by the fan assembly.

It can be noted that one end of the heat exchanger 3 is connected with a refrigerant pipe, forming a refrigerant flow circulated between the indoor unit 100 and the outdoor unit of the air conditioner. Since operations like connecting tubes or cleaning are necessary in the installation process or the routine maintenance process of the indoor unit 100, the chassis 12 is bent at the bottom to form a bottom plate which has a dismounting mouth communicated with the mounting cavity. The dismounting mouth is in a long strip shape extending in the left-right directions of the indoor unit 100. Further, the dismounting mouth should at least enable the joint part of the refrigerant pipe and the drain pipe exposed.

The width of the dismounting mouth in the front-rear direction of the indoor unit 100 should be suitable for personnel hands or tools to extend into and directly mount/dismount the refrigerant pipe and the drain pipe. The refrigerant pipe joint and drain pipe joint can be exposed by disassembling and assembling the lower panel, facilitating the installation of pipelines. Certainly, an avoiding hole is also possible provided on the lower panel, and a cover plate (not shown) is connected to the periphery of the avoiding hole, which is configured to open or close the avoiding hole and further open or close the dismounting mouth. The disassembly and assembly can be carried out without opening the lower panel, bringing the process simple and convenient.

It should be noted that the indoor unit 100 further may include air guiding component in order to improve the air guiding effect of the indoor unit 100. The air guiding component is provided corresponding to the opening 213 of the volute 21. When air is flowing into the room from the opening 213 through the air guiding effect of the air guiding component, thereby conditioning the air.

In the present embodiment, the fan assembly 2 may further include a motor. The fan 22 is installed in the volute 21 provided corresponding to the opening 213 of the volute 21, while the motor is installed at one end of the volute 21. It can be noted that the volute 21 is formed with an air duct, and the fan 22 is installed in the air duct of the volute 21.

In order to improve the aesthetics, the indoor unit 100 may further include a lower panel provided corresponding to the opening 213 of the volute 21. The lower panel can be opened by rotating relative to the front frame 11 or the chassis 12. Alternatively, the lower panel may be provided with an air outlet provided corresponding to the opening 213 of the volute 21. When the lower panel is opened, the fan assembly located inside the opening 213 can be exposed.

The heat exchanger 3 includes at least a front heat exchange part and a rear heat exchange part which matches with the front heat exchange part, and forms a flaring downward by enclosing with the front heat exchange. The rear heat exchange part is adjacent to the chassis 12. The inlet of the air duct is connected with the flaring formed by the heat exchanger 3, while the outlet of the air duct is connected with the opening 213. Under the drive of the fan 22, air outside enters into the air inlet 11*a* and flows out from the opening 213 through the air duct.

In one embodiment, the volute 21 may be further provided with a water receiving plate, which can be divided into a front water receiving plate and a rear water receiving plate. The front water receiving plate is configured to receive the condensed water generated in the heat exchange process of the front heat exchange part, while the rear water receiving plate is configured to receive the condensed water generated in the heat exchange process of the rear heat exchange part. And a water outlet pipe may be provided at at least one of the left and right ends of the water receiving plate, and the water outlet pipe at the water receiving plate is connected with a drain pipe, configured to discharge the condensed water out of the indoor unit 100. The water outlet pipeline is also exposed at the mounting mouth 1*b*, which is convenient when the drain pipe to disassemble or repair.

According to the indoor unit 100 of the present disclosure, a larger space is made available by dividing the chassis into a chassis 12 and a volute 21, forming a mounting mouth 1*b* by enclosing the front frame 11 and the chassis 12, providing the fan 22 on the volute 21, connecting the volute 21 removably with the front frame 11 and the chassis 12 respectively, and exposing the volute at the mounting mouth 1*b*. Such arrangements are configured to facilitate the disassembly, assembly and cleaning of the fan assembly 2, and improve the cleaning convenience of the fan assembly 2 in the indoor unit 100. In addition, the volute 21 can be removably connected to the front frame 11 and the chassis 12, so that it would be more stable for the fan assembly 2 to be mounted on the housing 1. The exposure to danger by opening the volute 21 accidentally will be further lowered, with the structural stability enhanced of the indoor unit 100, and working performance improved.

In one embodiment, as shown in FIGS. 1, 2, 4, 5 and 8, one of the front frame 11 and the fan assembly 2 is provided with a first buckle 114, the other one is provided with a first buckle slot 211. The front frame 11 is removably connected with the fan assembly 2 through the snap fit between the first buckle 114 and the first buckle slot 211.

It can be noted that the arrangement of the first buckle 114 and the first buckle slot 211 contributes to facilitate the detachable connection between the front frame 11 and the fan assembly 2. In one embodiment, the first buckle 114 may be provided on the front frame 11, and the first buckle slot 211 may be provided on the volute 21 of the fan assembly 2. Certainly, the first buckle 114 may also be provided on the volute 21 of the fan assembly 2, and the first buckle slot 211 may also be provided on the front frame 11. Alternatively, the first buckle 114 and the first buckle slot 211 may be snap-fit, plug-fit, screw-fit, pin-fit, etc., as long as it is a structure capable of implementing the detachable connection between the front frame 11 and the volute 21 of the fan assembly 2. No limitation should be addressed herein.

In one embodiment, as shown in FIGS. 1, 3, 4 and 6, one of the chassis 12 and the fan assembly 2 is provided with a second buckle 124, and the other of the chassis 12 and the fan assembly 2 is provided with a second buckle slot 212. The chassis 12 is removably connected with the fan assembly 2 through the snap fit between the second buckle 124 and the second buckle slot 212.

It can be noted that the arrangement of the second buckle 124 and the second buckle slot 212 contributes to facilitate the detachable connection between the chassis 12 and the fan assembly 2. In one embodiment, the second buckle 124 may be provided on the chassis 12, and the second buckle slot 212 may be provided on the volute 21 of the fan assembly 2. Certainly, the second buckle 124 may also be provided on the volute 21 of the fan assembly 2, and the second buckle slot 212 may also be provided on the chassis 12. Alternatively, the second buckle 124 and the second buckle slot 212 may be snap-fit, plug-fit, screw-fit, pin-fit, etc., as long as it is a structure capable of implementing the detachable connection between the chassis 12 and the volute 21 of the fan assembly 2. No limitation should be addressed herein.

It should be noted that the structures of the first buckle 114 and the second buckle 124 may be same or different. In the present embodiment, the first buckle 114 and the second buckle 124 may be the same structure. As such, the first buckle slot 211 and the second buckle slot 212 are also equivalent or the same in structure.

As shown in FIGS. 1-8, as an optional embodiments to the present disclosure, the first buckle 114 is provided on the front frame 11 adjacent to the mounting mouth 1*b*, and the second buckle 124 is provided on the chassis 12 adjacent to the mounting mouth 1*b*. The first buckle slot 211 fit with the first buckle 114 is provided on the fan assembly 2 adjacent to the front frame 11, and the second buckle slot 212 fit with the second buckle 124 is provided on the fan assembly 2 adjacent to the chassis 12.

In order to improve the installation stability of the fan assembly 2, as shown in FIG. 1, in one embodiment, the front frame 11 may be provided with a plurality of first buckles 114 which are spaced apart, and the chassis 12 may be provided with a plurality of second buckles 124 which are spaced apart. The volute 21 of the fan assembly 2 is respectively provided with a plurality of first buckle slots 211 that are spaced apart and a plurality of second buckle slots 212 that are spaced apart.

It can be noted that a portion of adjacent to the mounting mouth 1*b* the front frame 11 is provided with a plurality of first buckles 114, which are spaced at a uniform interval; a portion of the volute 21 of the fan assembly 2 adjacent to the front frame 11 is provided with a plurality of first buckle slots 211, which are spaced at a uniform interval. And each of the first buckles 114 is snap fit with the first buckle slots 211 in pair. Optionally, a portion of the front frame 11 is provided with two first buckles 114 adjacent to the mounting mouth 1*b*, and correspondingly, a portion of the volute 21 of the fan assembly 2 adjacent to the front frame 11 is provided with two first buckle slots 211.

A portion of the chassis 12 adjacent to the mounting mouth 1*b* is provided with a plurality of second buckles 124, which are spaced at a uniform interval; a portion of the volute 21 of the fan assembly 2 adjacent to the chassis 12 is provided with a plurality of second buckle slots 212, which are spaced at a uniform interval. And each of the second buckles 124 is snap fit with the second buckle slots 212 in pair. Optionally, a portion of the chassis 12 adjacent to the mounting mouth 1*b* is provided with two second buckles 124, and correspondingly, a portion of the volute 21 of the fan assembly 2 adjacent to the chassis 12 is provided with two second buckle slots 212.

In one embodiment, as shown in FIGS. 2, 5, 6, and 9, the first buckle 114 and the second buckle 124 each includes a main body portion 1141, a rotating portion 1142 connected to the main body portion 1141, and a buckling portion 1143. That is, the first buckle 114 and the second buckle 124 are same in structure.

In the present embodiment, the first buckle 114 is rotatably connected with the front frame 11 through the rotating portion 1142, and the first buckle 114 is snap-fit with the first buckle slot 211 through the buckling portion 1143. It should be noted that, the first buckle 114 and the front frame 11 are movably connected, which is beneficial to the snap fit between the first buckle 114 and the first buckle slot 211. Further, the influence can be lowered on disassembly and assembly of the volute 21 of the fan assembly 2, after the first buckle 114 is connected with the front frame 11. Optionally, the first buckle 114 and the front frame 11 are removably connected, thus facilitating the disassembly and replacement of the first buckle 114.

In the present embodiment, the second buckle 124 is rotatably connected with the chassis 12 through the rotating portion 1142, and the second buckle 124 is in snap fit with the second buckle slot 212 through the buckling portion 1143. It should be noted that, the second buckle 124 and the chassis 12 are movably connected, which is beneficial to the snap fit between the second buckle 124 and the second buckle slot 212. Further, the influence can be lowered on disassembly and assembly of the volute 21 of the fan assembly 2, after the second buckle 124 is connected with the chassis 12. Optionally, the second buckle 124 and the chassis 12 are removably connected, thus facilitating the disassembly and replacement of the second buckle 124.

In one embodiment, as shown in FIGS. 2-9, the rotating portion 1142 is provided with a rotating shaft 115; a portion of the front frame 11 adjacent to the mounting mouth 1*b* is provided with a first shaft aperture 111, which is fit with the rotating shaft 115. The first buckle 114 is rotatably connected with the front frame 11 through the fit between the rotating shaft 115 and the first shaft aperture 111. A portion of the chassis 12 adjacent to the mounting mouth 1*b* is provided with a second shaft aperture 121, which is fit with the rotating shaft 115. The second buckle 124 is rotatably connected with the chassis 12 through the fit between the rotating shaft 115 and the second shaft aperture 121.

It should be noted that the rotating portion 1142 of the first buckle 114 is provided with a rotating shaft 115. The rotating portion 1142 of the first buckle 114 is rotatably connected with the front frame 11 through the fit between the rotating shaft 115 and the first shaft aperture 111, so that the first buckle 114 rotates more smoothly relative to the front frame 11 from the front to the rear. At least one rotating shaft 115 is provided, for example two rotating shafts can be provided. The two rotating shafts 115 are provided at both ends of the rotating portion 1142 of the first buckle 114, to improve the stability of rotational connection.

In one embodiment, the rotating shafts 115 are provided in pairs. A pair of rotating shafts 115 includes two rotating shafts 115 provided opposite to each other. Correspondingly, a pair of first shaft apertures 111 is provided with two shaft apertures with openings facing each other. And an avoiding space is provided between the two shaft apertures to facilitate the rotation of the lower panel as well as the installation of the rotating shaft 115. Due to such arrangement, the respective fit of the two rotating shafts 115 with the first shaft aperture 111 has a tendency of abutting against each other, so that the rotational connection is more stable. The possibility of accidental falling-off will be lowered, and the mounting stability of the lower panel is thus improved.

In other embodiments, the rotating portion 1142 of the first buckle 114 and the front frame 11 may be rotatably connected by a hinge or the like. No limitation should be addressed herein. Certainly, the first buckle 114 and the front frame 11 can also be rotatably connected through a plug-socket, a rotary buckle or some other means.

It should be noted that the rotating portion 1142 of the second buckle 124 is provided with a rotating shaft 115. The rotating portion 1142 of the second buckle 124 is rotatably connected with the chassis 12 through the fit between the rotating shaft 115 and the second shaft aperture 121, so that the second buckle 124 rotates more smoothly relative to the chassis 12 from the front to the rear. At least one rotating shaft 115 is provided, for example two rotating shafts can be provided. The two rotating shafts 115 are provided at both ends of the rotating portion 1142 of the second buckle 124, to improve the stability of rotational connection.

In one embodiment, the rotating shafts 115 are provided in pairs. A pair of rotating shafts 115 includes two rotating shafts 115 provided opposite to each other. Correspondingly, a pair of second shaft apertures 121 is provided with two shaft apertures with openings facing each other. And an avoiding space is provided between the two shaft apertures to facilitate the rotation of the lower panel as well as the installation of the rotating shaft 115. Due to such arrangement, the respective fit of the two rotating shafts 115 with the second shaft aperture 121 has a tendency of abutting against each other, so that the rotational connection is more stable. The possibility of accidental falling-off will be lowered, and the mounting stability of the lower panel is thus improved.

In other embodiments, the rotating portion 1142 of the second buckle 124 and the chassis 12 may be rotatably connected by a hinge or the like. No limitation should be addressed herein. Certainly, the second buckle 124 and the chassis 12 can also be rotatably connected through a plug-socket, a rotary buckle or some other means. Certainly, the rotating portion 1142 of the second buckle 124 and the chassis 12 may be rotatably connected by a hinge or the like. No limitation should be addressed herein.

It should be noted that the first buckle 114/the second buckle 124 can be buckled or disengaged from the first buckle slot 211/the second buckle slot 212 by rotation, thus improving the disassembly and assembly convenience of the volute 21 of the fan assembly 2.

Figure 2:
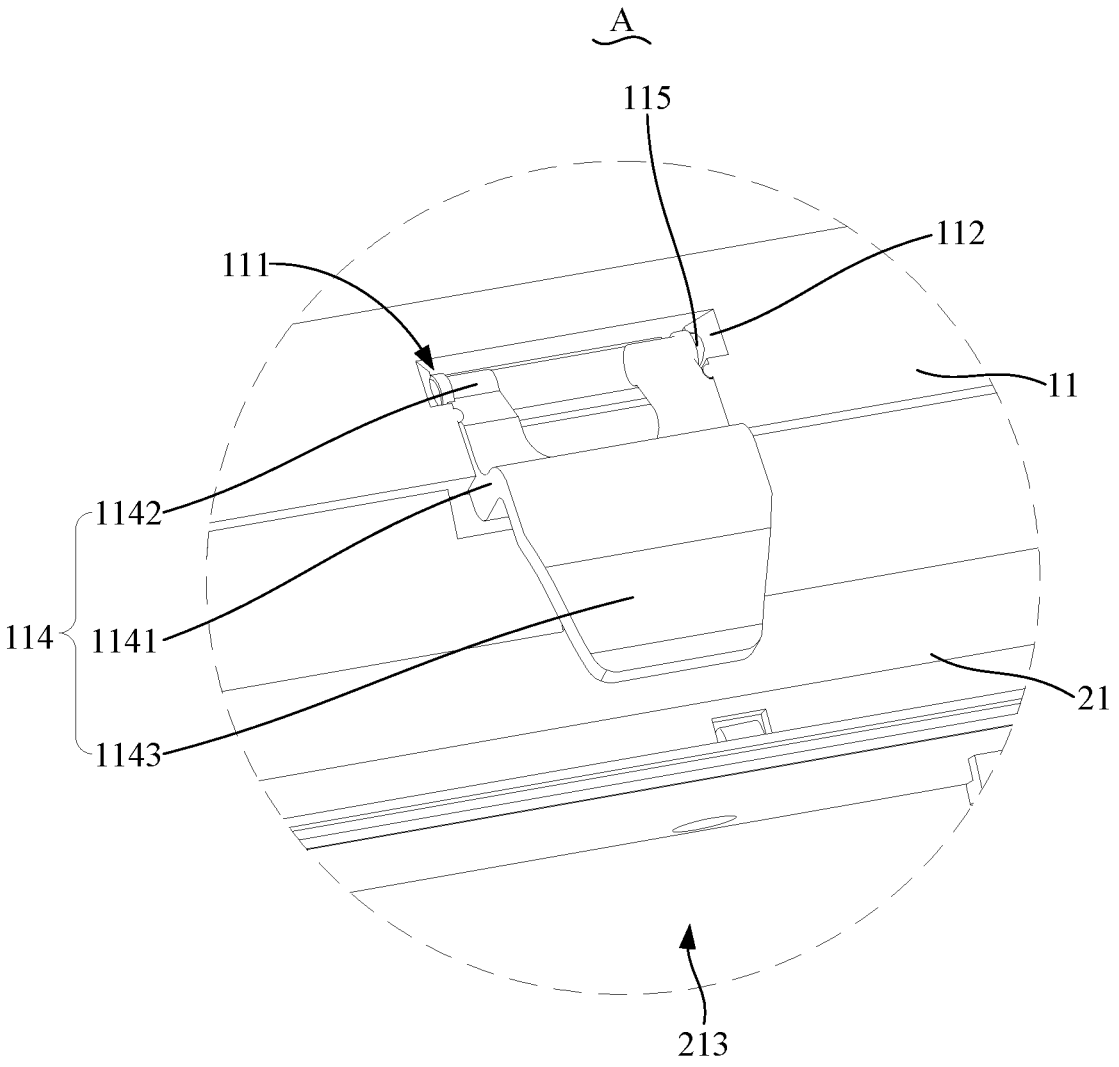
FIG. 2 is an enlarged schematic diagram at position A in FIG. 1.
Figure 3:
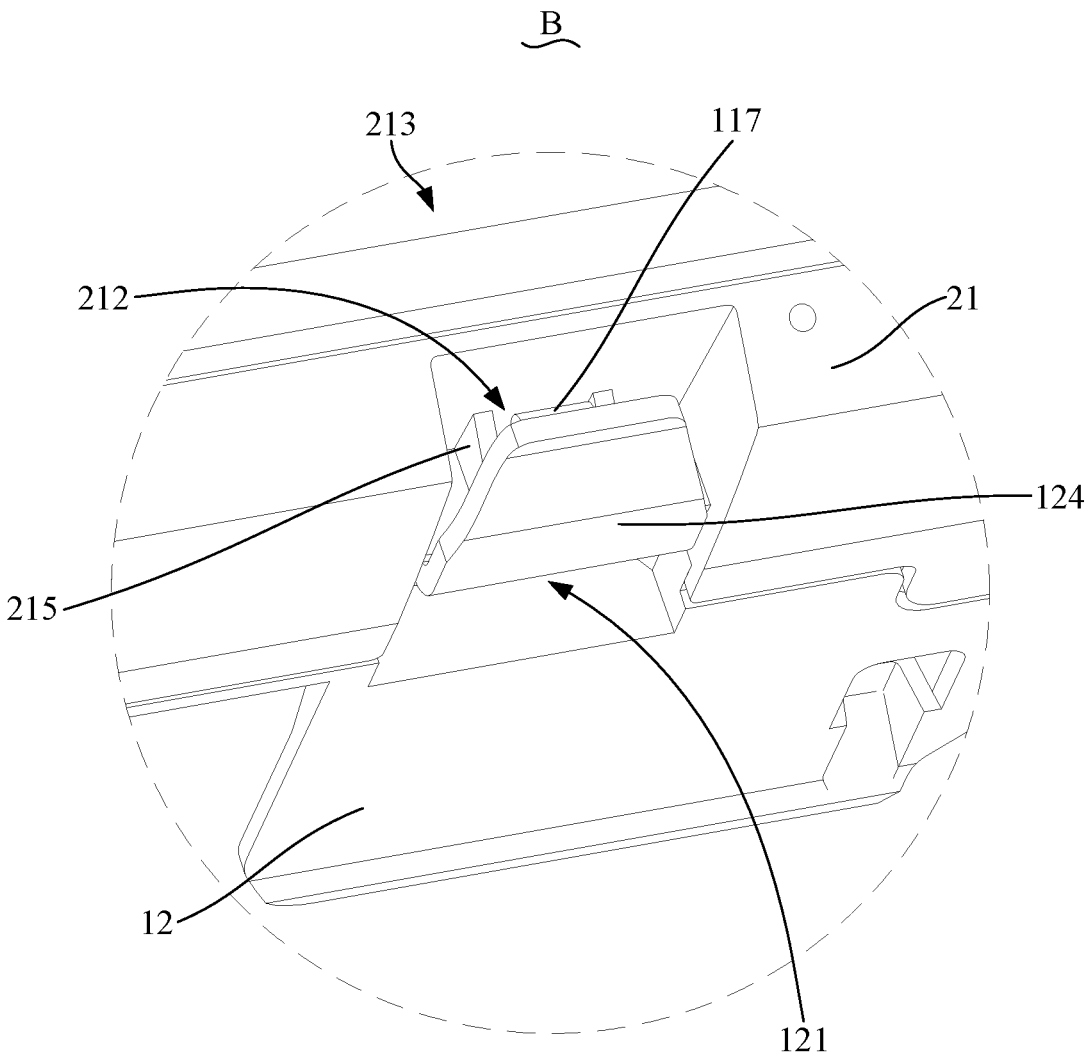
FIG. 3 is an enlarged schematic diagram at position B in FIG. 1.
Figure 8:
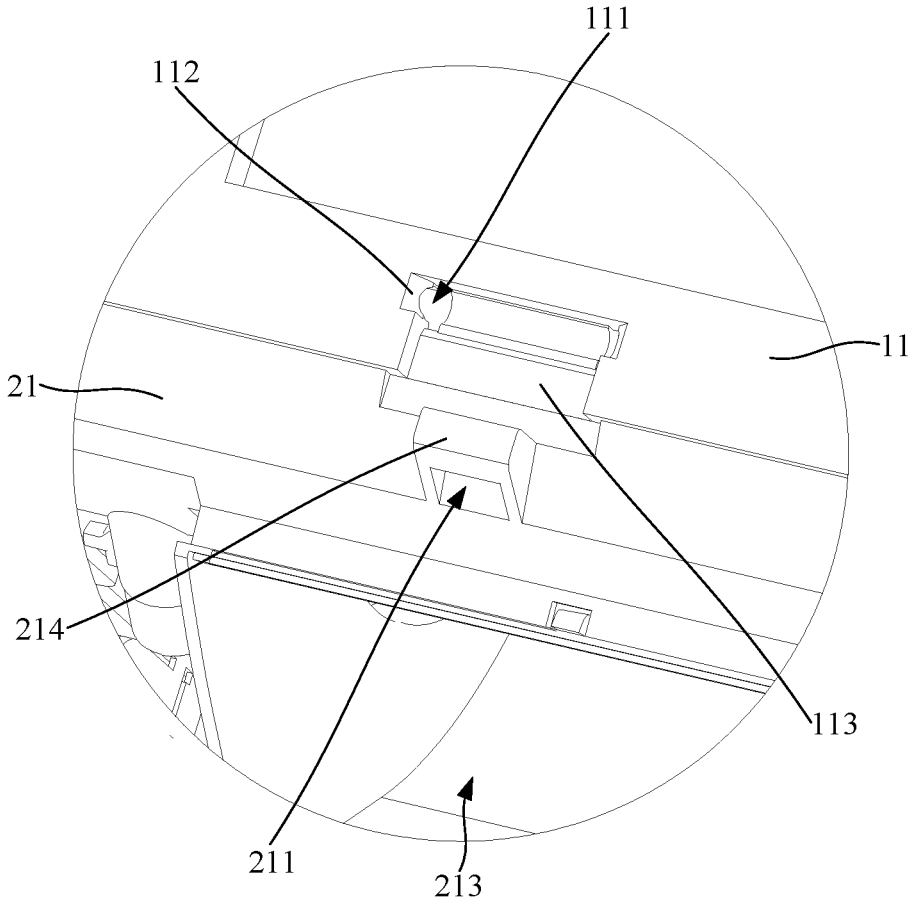
FIG. 8 is a structural schematic diagram of a part of an indoor unit where a first buckle is removed according to an embodiment of the present disclosure.

In one embodiment, as shown in FIGS. 2 and 8, the outer periphery of the first shaft aperture 111 and/or the second shaft aperture 121 is provided with a guiding surface 112 configured to slide the rotating shaft 115 in the shaft aperture.

It should be noted that, the outer periphery of the first shaft aperture 111 is provided with a guiding surface 112 configured to slide the rotating shaft 115 in the shaft aperture. That is, the outer periphery of the first shaft aperture 111 is provided with an inclined guiding surface 112, i.e. the guiding surface 112 is gradually inclined toward the inner side of the front frame 11, from one shaft aperture of the first shaft aperture 111 to the other shaft aperture. The rotating shaft 115 of the first buckle 114 can slide into the first shaft aperture 111 by the inclined guiding surface 112, thus facilitating the installation and fitting between the first buckle 114 and the front frame 11.

Certainly, the outer periphery of the second shaft aperture 121 is provided with a guiding surface 112 configured to slide the rotating shaft 115 in the shaft aperture. That is, the outer periphery of the second shaft aperture 121 is provided with an inclined guiding surface 112, i.e. the guiding surface 112 is gradually inclined toward the inner side of the chassis 12, from one shaft aperture of the first shaft aperture 111 to the other shaft aperture. The rotating shaft 115 of the second buckle 124 can slide into the second shaft aperture 121 by the inclined guiding surface 112, thus facilitating the installation and fitting between the second buckle 124 and the chassis 12.

Figure 9:
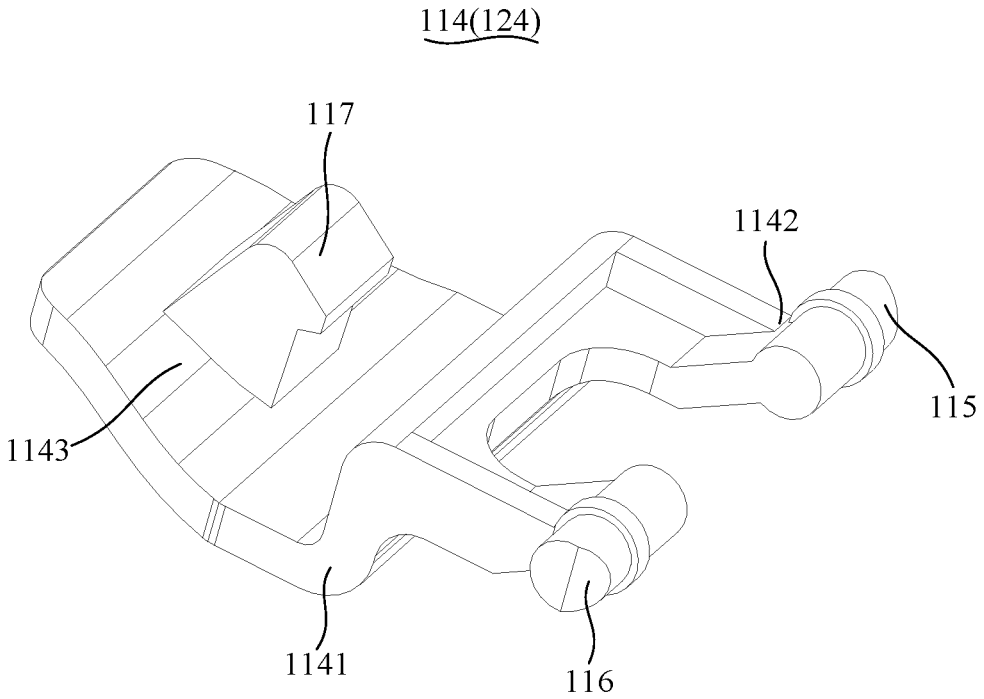
FIG. 9 is a schematic structural diagram of a first buckle and a second buckle according to an embodiment of the present disclosure.

In one embodiment, as shown in FIG. 9, the end surface of the rotating shaft 115 is formed with a mating surface 116 configured to slide rotating shaft into the first shaft aperture 111 or the second shaft aperture 121.

It should be noted that the end surface of the rotating shaft 115 of the first buckle 114 is formed with a mating surface 116 configured to slide the rotating shaft 115 into the first shaft aperture 111. That is, the end surface of the rotating shaft 115 of the first buckle 114 is formed with an inclined mating surface 116, facing the first shaft aperture 111 and parallel to the guiding surface 112. When the rotating shaft 115 of the first buckle 114 is inserted into the first shaft aperture 111, the mating surface 116 of the rotating shaft 115 slides into the first shaft aperture 111 along the aperture wall, thus facilitating the installation and fitting between the first buckle 114 and the front frame 11. That is, when the first buckle 114 is installed, the mating surfaces 116 of the two rotating shafts 115 are pressed against the guiding surfaces 112, and the rotating shafts 115 can slide into the first shaft aperture 111, thus improving the installation efficiency and convenience.

Certainly, the end surface of the rotating shaft 115 of the second buckle 124 is formed with a mating surface 116 configured to slide the rotating shaft 115 into the second shaft aperture 121. That is, the end surface of the rotating shaft 115 of the second buckle 124 is formed with an inclined mating surface 116, facing the second shaft aperture 121 and parallel to the guiding surface 112. When the rotating shaft 115 of the second buckle 124 is inserted into the second shaft aperture 121, the mating surface 116 of the rotating shaft 115 slides into the second shaft aperture 121 along the aperture wall, thus facilitating the installation and fitting between the second buckle 124 and the chassis 12. That is, when the second buckle 124 is installed, the mating surfaces 116 of the two rotating shafts 115 are pressed against the guiding surfaces 112, and the rotating shafts 115 can slide into the second shaft aperture 121, thus improving the installation efficiency and convenience.

As an optional solution to the present embodiment, the outer periphery of the first shaft aperture 111 is provided with a guiding surface 112 configured to slide the rotating shaft 115 of the first buckle 114 into the first shaft aperture. The end surface of the rotating shaft 115 of the first buckle 114 is formed with a mating surface 116 configured to slide the rotating shaft 115 into the first shaft aperture 111. The outer periphery of the second shaft aperture 121 is provided with a guiding surface 112 configured to slide the rotating shaft 115 of the second buckle 124 into the first shaft aperture. The end surface of the rotating shaft 115 of the second buckle 124 is formed with a mating surface 116 configured to slide the rotating shaft 115 into the second shaft aperture 121.

In one embodiment, as shown in FIGS. 4, 5, 7 and 8, the front frame 11 is further provided with a first avoiding area 113 communicating the first shaft aperture 111 and the mounting mouth 1*b*. When the first buckle 114 connects the front frame 11 and the fan assembly 2, a portion of the main body portion 1141 is accommodated in the first avoiding area 113.

It can be noted that such arrangement is to increase the avoiding area on the front frame when the first buckle 114 is fitted with the first buckle slot 211, and prevent a loose fit between the first buckle 114 and the first buckle slot 211.

Figure 6:
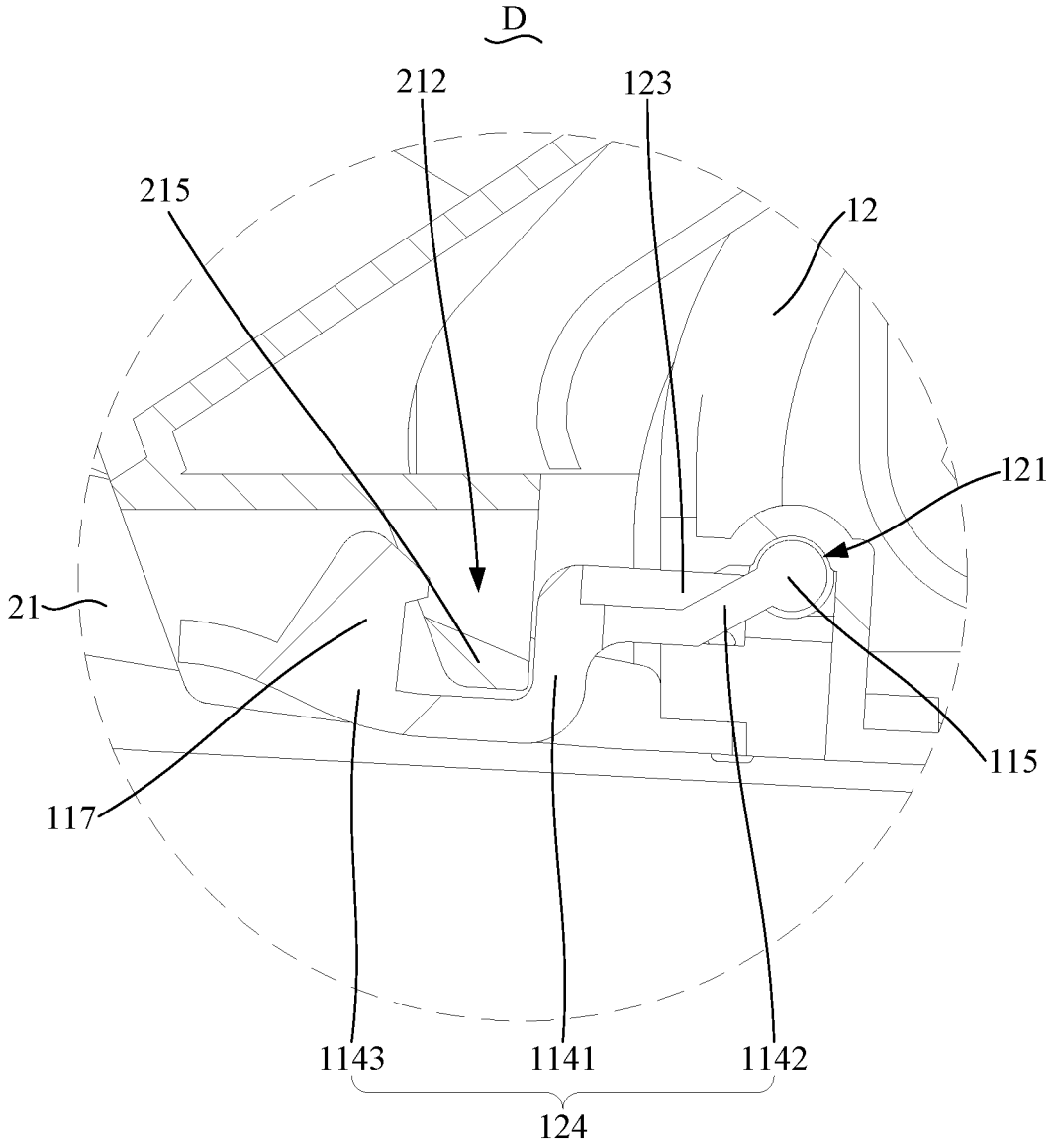
FIG. 6 is an enlarged schematic diagram at position D in FIG. 4.
Figure 7:
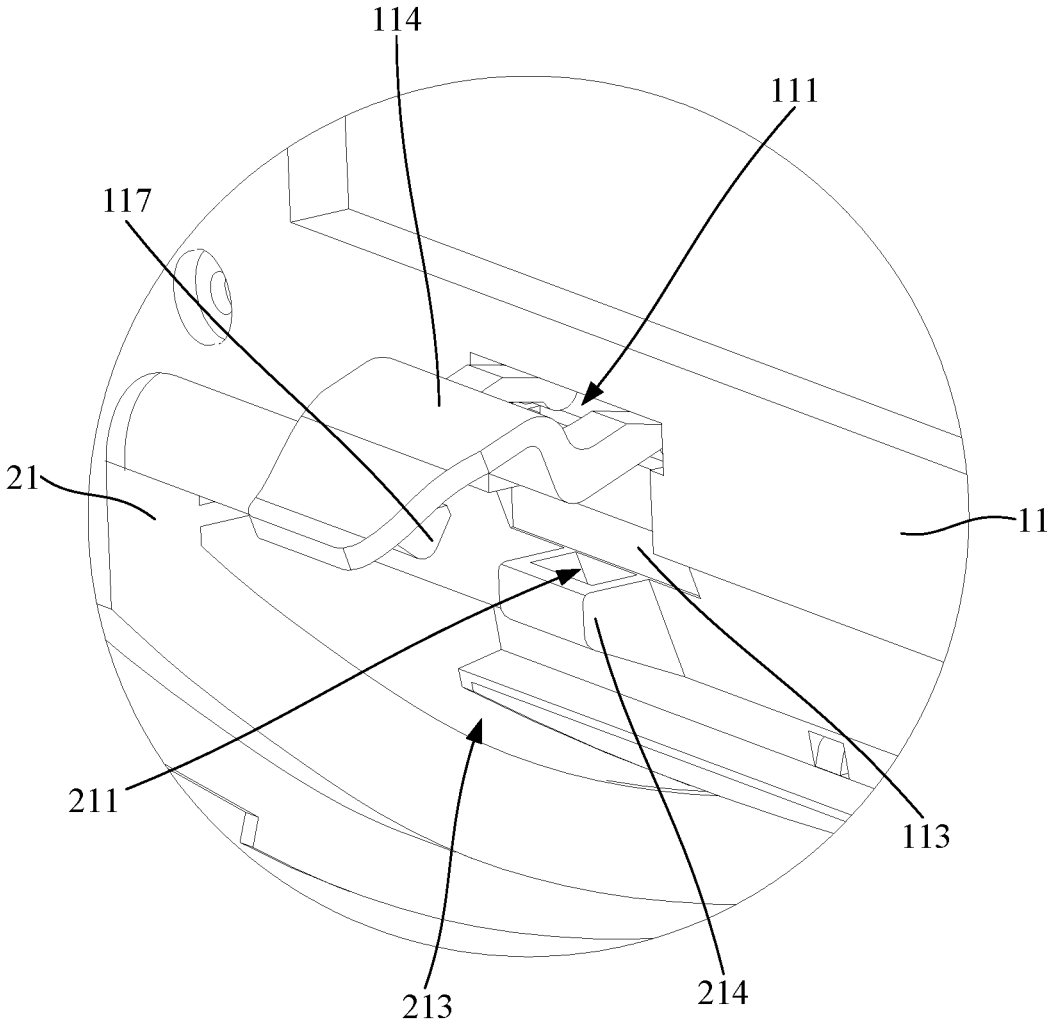
FIG. 7 is a structural schematic diagram of a part of an indoor unit according to an embodiment of the present disclosure.

In one embodiment, as shown in FIGS. 4 and 6, the chassis 12 is further provided with a second avoiding area 123 communicating the second shaft aperture 121 and the mounting mouth 1*b*. When the second buckle 124 connects the chassis 12 and the fan assembly 2, a portion of the main body portion 1141 is accommodated in the second avoiding area 123.

It should be noted that such arrangement is to increase the avoiding area on the front frame when the second buckle 124 is fitted with the second buckle slot 212, and prevent a loose fit between the second buckle 124 and the second buckle slot 212.

In one embodiment, as shown in FIGS. 3-9, a portion of the volute 21 adjacent to the front frame 11 is provided with a first boss 214. The first boss 214 is provided with the first buckle slot 211 penetrating through the first boss in the up-down direction. A portion of the volute adjacent to the chassis 12 is provided with a second boss 215, and the second boss 215 is provided with the second buckle slot 212 penetrating through in the up-down direction. The buckling portion 1143 is a buckling hook 117. The first buckle 114 rotates relative to the front frame 11, to allow the buckling hook 117 to be buckled with the lower end of the first buckle slot 211. The second buckle 124 rotates relative to the chassis 12, to allow the buckling hook 117 to be buckled to the lower end of the second buckle slot 212.

It should be noted that the first buckle 114 and the second buckle 124 are the same in structure. The buckling portion 1143 of the first buckle 114 is a buckling hook 117 which is in snap fit with the first buckle slot 211, and the buckling portion 1143 of the second buckle 124 is a buckling hook 117 which is in snap fit with the second buckle slot 212. As such, the connection stability would be enhanced of the first buckle 114 and the second buckle 124 with the volute 21 of the fan assembly 2, preventing a loose installation of the volute 21.

The present disclosure further provides an air conditioner, which includes an outdoor unit and the indoor unit 100, in which the outdoor unit is connected with the indoor unit 100 through pipelines. The structure of the indoor unit 100 of the air conditioner can be referred to in the aforementioned embodiments. As the air conditioner takes all the technical solutions of the above embodiments, it has at least all the significance and effects brought by the technical solution of the above embodiments, and will not be described in detail herein.

This is only some embodiments of the present disclosure and is not intended to limit the scope of the present disclosure. Any equivalent structural change made under the concept of the present disclosure using the contents of the present disclosure specification and drawings, or directly/indirectly applied in other related technical fields, shall be included in the protection scope of the present disclosure.

What is claimed is:

1. An indoor unit of an air conditioner, the indoor unit comprising:

a housing comprising:

a chassis configured to be mounted to a wall; and a front frame connected with the chassis, wherein the front frame and the chassis are configured to be joined to define a mounting cavity having a mounting mouth opened downwards; and a fan assembly positioned in the mounting cavity and exposed to an outside at the mounting mouth, wherein the fan assembly is configured to be removably connected with the front frame and the chassis;

a first buckle positioned on a portion of the front frame adjacent to the mounting mouth;

a second buckle positioned on a portion of the chassis adjacent to the mounting mouth;

a first buckle slot positioned on a first portion of the fan assembly adjacent to the front frame to fit with the first buckle; and a second buckle slot positioned on a second portion of the fan assembly adjacent to the chassis to fit with the second buckle, wherein each of the first buckle and the second buckle comprises:

a main body portion;

a rotating portion connected to the main body portion; and a buckling portion, wherein the first buckle is configured to be rotatably connected with the front frame through the rotating portion of the first buckle, and to be in a snap fit with the first buckle slot through the buckling portion of the first buckle, and wherein the second buckle is configured to be rotatably connected with the chassis through the rotating portion of the second buckle, and to be in a snap fit with the second buckle slot through the buckling portion of the second buckle.

2. The indoor unit according to claim 1, wherein the rotating portion comprises a rotating shaft, wherein the portion of the front frame adjacent to the mounting mouth defines a first shaft aperture configured to fit with the rotating shaft of the rotating portion of the first buckle, and the first buckle is configured to be rotatably connected with the front frame through a fit between the rotating shaft of the rotating portion of the first buckle and the first shaft aperture, and wherein the portion of the chassis adjacent to the mounting mouth defines a second shaft aperture configured to fit with the rotating shaft of the rotating portion of the first buckle, and the second buckle is configured to be rotatably connected with the chassis through a fit between the rotating shaft of the rotating portion of the second buckle and the second shaft aperture.

3. The indoor unit according to claim 2, wherein the portion of the front frame defines an outer periphery of the first shaft aperture, wherein the outer periphery of the first shaft aperture is configured to guide the rotating shaft of the rotating portion of the first buckle into the first shaft aperture, and wherein the portion of the chassis defines an outer periphery of the second shaft aperture, wherein the outer periphery of the second shaft aperture is configured to guide the rotating shaft of the rotating portion of the second buckle into the second shaft aperture.

4. The indoor unit of claim 2, wherein an end surface of the rotating shaft defines a mating surface, wherein the mating surface of the rotating shaft of the first buckle is configured to slide into the first shaft aperture; and wherein the mating surface of the rotating shaft of the second buckle is configured to slide into the second shaft aperture.

5. The indoor unit according to claim 2, wherein the front frame further defines a first avoiding area that communicates the first shaft aperture and the mounting mouth, and wherein the first avoiding area is configured such that, in a state where the front frame is connected with the fan assembly through the first buckle, a part of the main body portion of the first buckle is accommodated in the first avoiding area.

6. The indoor unit according to claim 2, wherein the chassis further defines a second avoiding area that communicates the second shaft aperture and the mounting mouth, and wherein the second avoiding area is configured such that, in a state where the chassis is connected with the fan assembly through the second buckle, a part of the main body portion of the second buckle is accommodated in the second avoiding area.

7. The indoor unit according to claim 1, wherein the fan assembly comprises:

a volute comprising:

a first boss adjacent to the front frame; and a second boss adjacent to the chassis; and a fan connected with the volute, wherein the first boss defines the first buckle slot passing through the first boss in an up-down direction, wherein the second boss defines the second buckle slot passing through the second boss in the up-down direction, wherein the buckling portion comprises a buckling hook, wherein the first buckle is configured to be rotated relative to the front frame to allow the buckling hook of the first buckle to be in a snap fit at a lower end of the first buckle slot, and wherein the second buckle is configured to be rotated relative to the chassis to allow the buckling hook of the second buckle to be in a snap fit at a lower end of the second buckle slot.

8. The indoor unit according to claim 7, wherein the volute defines an opening as a position that corresponds with a position of the fan.

9. The indoor unit according to claim 7, further comprising:

a plurality of the first buckle, wherein the plurality of the first buckle are spaced apart; and a plurality of the second buckle, wherein the plurality of the second buckle are spaced apart, wherein the volute defines a plurality of the first buckle slot, wherein the plurality of the first buckle slot are spaced apart, and wherein the volute defines a plurality of the second buckle slot, wherein the plurality of the second buckle slot are spaced apart.

10. An indoor unit of an air conditioner, the indoor unit comprising:

a housing comprising:

a chassis configured to be mounted to a wall; and a front frame connected with the chassis, wherein the front frame and the chassis are configured to be joined to define a mounting cavity having a mounting mouth opened downwards, and wherein a portion of the front frame away from the mounting mouth defines an air inlet communicated with the mounting cavity;

a fan assembly positioned in the mounting cavity and exposed to an outside at the mounting mouth, wherein the fan assembly is configured to be removably connected with the front frame and the chassis;

a heat exchanger provided in the mounting cavity and positioned between the air inlet and the fan assembly;

a first buckle positioned on a portion of the front frame adjacent to the mounting mouth;

a second buckle positioned on a portion of the chassis adjacent to the mounting mouth;

a first buckle slot positioned on a first portion of the fan assembly adjacent to the front frame to fit with the first buckle; and a second buckle slot positioned on a second portion of the fan assembly adjacent to the chassis to fit with the second buckle, wherein each of the first buckle and the second buckle comprises:

a main body portion;

a rotating portion connected to the main body portion; and a buckling portion, wherein the first buckle is configured to be rotatably connected with the front frame through the rotating portion of the first buckle, and to be in a snap fit with the first buckle slot through the buckling portion of the first buckle, and wherein the second buckle is configured to be rotatably connected with the chassis through the rotating portion of the second buckle, and to be in a snap fit with the second buckle slot through the buckling portion of the second buckle.

11. An air conditioner comprising:

an outdoor unit; and an indoor unit, wherein the outdoor unit is connected with the indoor unit through a pipeline, and wherein the indoor unit comprises:

a housing comprising:

a chassis configured to be mounted to a wall; and a front frame connected with the chassis, wherein the front frame and the chassis are configured to be joined to define a mounting cavity having a mounting mouth opened downwards; and a fan assembly positioned in the mounting cavity and exposed to an outside at the mounting mouth, wherein the fan assembly is configured to be removably connected with the front frame and the chassis;

a first buckle positioned on a portion of the front frame adjacent to the mounting mouth;

a second buckle positioned on a portion of the chassis adjacent to the mounting mouth;

a first buckle slot positioned on a first portion of the fan assembly adjacent to the front frame to fit with the first buckle; and a second buckle slot positioned on a second portion of the fan assembly adjacent to the chassis to fit with the second buckle, wherein each of the first buckle and the second buckle comprises:

a main body portion;

a rotating portion connected to the main body portion; and a buckling portion, wherein the first buckle is configured to be rotatably connected with the front frame through the rotating portion of the first buckle, and to be in a snap fit with the first buckle slot through the buckling portion of the first buckle, and wherein the second buckle is configured to be rotatably connected with the chassis through the rotating portion of the second buckle, and to be in a snap fit with the second buckle slot through the buckling portion of the second buckle.

12. The air conditioner according to claim 11, wherein the rotating portion comprises a rotating shaft, wherein the portion of the front frame adjacent to the mounting mouth defines a first shaft aperture configured to fit with the rotating shaft of the rotating portion of the first buckle, and the first buckle is configured to be rotatably connected with the front frame through a fit between the rotating shaft of the rotating portion of the first buckle and the first shaft aperture, and wherein the portion of the chassis adjacent to the mounting mouth defines a second shaft aperture configured to fit with the rotating shaft of the rotating portion of the first buckle, and the second buckle is configured to be rotatably connected with the chassis through a fit between the rotating shaft of the rotating portion of the second buckle and the second shaft aperture.

13. The air conditioner according to claim 12, wherein the front frame further defines a first avoiding area that communicates the first shaft aperture and the mounting mouth, wherein the first avoiding area is configured such that, in a state where the front frame is connected with the fan assembly through the first buckle, a part of the main body portion of the first buckle is accommodated in the first avoiding area, wherein the chassis further defines a second avoiding area that communicates the second shaft aperture and the mounting mouth, and wherein the second avoiding area is configured such that, in a state where the chassis is connected with the fan assembly through the second buckle, a part of the main body portion of the second buckle is accommodated in the second avoiding area.

14. The air conditioner according to claim 11,
wherein the fan assembly comprises:
a volute comprising:
a first boss adjacent to the front frame; and
a second boss adjacent to the chassis, and
a fan connected with the volute,
wherein the first boss defines the first buckle slot passing through the first boss in an up-down direction,
wherein the second boss defines the second buckle slot passing through the second boss in an up-down direction,
wherein the buckling portion comprises a buckling hook,
wherein the first buckle is configured to be rotated relative to the front frame to allow the buckling hook of the first buckle to be in a snap fit at a lower end of the first buckle slot, and wherein the second buckle is configured to be rotated relative to the chassis to allow the buckling hook of the second buckle to be in a snap fit at a lower end of the second buckle slot.

* * * * *